US007556476B1

(12) United States Patent
Liang

(10) Patent No.: US 7,556,476 B1
(45) Date of Patent: Jul. 7, 2009

(54) TURBINE AIRFOIL WITH MULTIPLE NEAR WALL COMPARTMENT COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 420 days.

(21) Appl. No.: 11/600,442

(22) Filed: Nov. 16, 2006

(51) Int. Cl.
*F01D 5/08* (2006.01)
*F01D 5/18* (2006.01)

(52) U.S. Cl. ..... 416/97 R; 415/115

(58) Field of Classification Search ..... 415/115, 415/116; 416/95, 96 R, 97 R
See application file for complete search history.

(56) References Cited

U.S. PATENT DOCUMENTS 3,844,678 A 10/1974 Sterman et al.
4,257,737 A 3/1981 Andress et al.
5,120,192 A * 6/1992 Ohtomo et al. ..... 415/115
5,348,446 A 9/1994 Lee et al.
5,356,265 A 10/1994 Kercher
5,498,133 A 3/1996 Lee
5,660,524 A 8/1997 Lee et al.
5,667,359 A 9/1997 Huber et al.
5,720,431 A 2/1998 Sellers et al.
5,779,437 A * 7/1998 Abdel-Messeh et al. .... 415/115
5,820,337 A 10/1998 Jackson et al.
5,931,638 A 8/1999 Krause et al.
6,036,441 A 3/2000 Manning et al.
6,168,381 B1 1/2001 Reddy
6,254,334 B1 * 7/2001 LaFleur ..... 415/115
6,318,960 B1 * 11/2001 Kuwabara et al. ..... 415/115
6,533,547 B2 3/2003 Anding et al.
6,595,748 B2 7/2003 Flodman et al.
6,742,991 B2 * 6/2004 Soechting et al. ..... 416/97 R
6,773,230 B2 8/2004 Bather et al.
6,916,150 B2 7/2005 Liang

* cited by examiner

*Primary Examiner*—Igor Kershteyn
(74) *Attorney, Agent, or Firm*—John Ryznic

(57) ABSTRACT

The present invention is a turbine airfoil such as a rotor blade with a cooling circuit that provides convective cooling to the airfoil main body, and impingement cooling and film cooling to the outer wall of the airfoil in order to maximize the cooling while minimizing the amount of cooling air used. The blade main body includes walls of such thickness to provide sufficient structural strength to support the airfoil assembly. The blade main body includes a rib that separates a first or forward cooling air supply channel from a spent air collector cavity. Another rib separates the spent air collector cavity from a second or mid-chord cooling air supply channel. A leading edge cooling supply cavity is connected to the forward supply channel through metering and impingement holes. Film cooling holes forming a well known showerhead arrangement provides film cooling for the leading edge of the blade.

18 Claims, 2 Drawing Sheets

TURBINE AIRFOIL WITH MULTIPLE NEAR WALL COMPARTMENT COOLING

BACKGROUND OF THE INVENTION

1. Field of the Invention

The present invention relates generally to fluid reaction surfaces, and more specifically to turbine airfoils with cooling circuits.

2. Description of the Related Art Including Information Disclosed Under 37 CFR 1.97 and 1.98

In a gas turbine engine, especially in an industrial gas turbine engine, compressed air is delivered to a combustor and burned with a fuel to produce an extremely hot gas flow. The hot gas flow is passed through a multiple stage turbine to extract mechanical energy. The engine efficiency can be increased by increasing the temperature of the hot gas flow entering the turbine. One of the major problems with the design of gas turbine engines is forming the first stage stator vanes and rotor blades from materials that can withstand the extreme high temperature of the hot gas flow. In order to overcome the limitations due to the material properties, complex internal cooling circuits have been proposed to provide high levels of cooling for these airfoils while minimizing the amount of cooling air used. Since the pressurized cooling air is typically diverted from the compressor of the engine, which is compressed air that is not used to perform work, using less air from the compressor for cooling will also increase the engine efficiency.

Prior Art turbine airfoils near wall cooling utilized in an airfoil main body is constructed with radial flow channels plus re-supply holes in conjunction with film discharge cooling holes. As a result of this cooling construction approach, span-wise and chord-wise cooling flow control due to airfoil external hot gas temperature and pressure variation is difficult to achieve. In addition, single radial channel flow is not the best method of utilizing cooling air, resulting in a low convective cooling effectiveness. U.S. Pat. No. 5,660,524 issued to Lee et al on Aug. 26, 1997 and entitled AIRFOIL BLADE HAVING A SERPENTINE COOLING CIRCUIT AND IMPINGEMENT COOLING discloses a turbine airfoil blade with generally longitudinally extending coolant passageways (#40, 42, and 44 in this patent) with first and second impingement chambers (#53 and 60 in this patent) located on the pressure side and the suction side of the blade adjacent to the coolant passageway. The two impingement chambers also extend along the entire span-wise direction of the blade from the root to the blade tip. One problem with this design is that the blade may have hot spots along the span-wise direction. Because the impingement chamber is one long passage, some areas of the blade along the span-wise direction may be under-cooled while others may be over-cooled.

U.S. Pat. No. 6,773,230 B2 issued to Bather et al on Aug. 10, 2004 and entitled AIR COOLED AEROFOIL discloses a turbine airfoil with a central cooling air supply channel and a series of cooling wall cavities spaced along the airfoil wall and connected to the cooling air supply channel by impingement holes. The impingement cavities can be separated into a plurality of compartments spaced along the airfoil span-wise direction in order to increase the efficiency of such a cooling arrangement (see column 3, line 42 of this patent). In the Bather et al patent, the source of cooling air supply is only connected to the central cavity (#34 in this patent), and this central cavity is in direct fluid communication with the film cooling holes that provide cooling for the leading edge showerhead arrangement. Also, the impingement cooling air passes into the second cavity (#26 in this patent) which is located downstream from the first or supply cooling air cavity. Therefore, a series flow is formed that passes from the first cooling air supply cavity 34, into the impingement cavities 24 and 28, into the second cavity 26, and then into a trailing edge cavity 26 and out through exit cooling holes 44 in the trailing edge of the airfoil. This is a long flow path for the cooling air, which results in lower efficiency because the cooling air heats up before reaching the middle and trailing edge portions of the airfoil.

It is an object of the present invention to provide a turbine airfoil with a near wall cooling arrangement for a turbine airfoil main body region that will greatly reduce the airfoil main body metal temperature and thus reduce the cooling flow requirement and improve the turbine efficiency.

It is another object of the present invention to provide for a turbine airfoil in which the airfoil is cooled by a cooling air circuit that uses convection in series with impingement cooling and film cooling to maximize the heat transfer coefficient while minimizing the amount of cooling air used.

BRIEF SUMMARY OF THE INVENTION

A turbine airfoil with a multiple near wall cooled compartments in conjunction with multi-hole impingement cooling construction for the airfoil main body. A forward cooling air supply channel supplies cooling air to impingement holes on the suction side and the pressure side of the cooling supply channel. Cooling air is supplied to three cooling supply channels in the airfoil. A forward cooling supply channel supplies cooling air through impingement holes on the suction side of the airfoil in which the impingement cooling air collects before discharging out film cooling holes on the suction side. A mid-chord cooling air supply channel supplies cooling air to a suction side cavity compartment through impingement holes. Both the forward and mid-chord cooling supply channels supply cooling air through impingement holes on the pressure side into a common impingement cavity compartment along the pressure side. Spaced between the forward and mid-chord cooling supply channels is a spent air collector cavity in which the impingement air from the common pressure side impingement cavity compartment and the mid-chord suction side impingement cavity compartment is collected, this collected spent air then discharged through film cooling holes on the suction side upstream from the gage point. A leading edge cooling air supply cavity is connected to the forward cooling air supply channel through metering holes, and discharges cooling air onto the leading edge through the showerhead film cooling holes. A separate cooling air supply channel is located in the trailing edge region, and supplies cooling air through impingement holes on the pressure side and suction side into impingement cavity compartments on the pressure side and suction side. The two trailing edge impingement cavity compartment then discharge the cooling air through exit holes spaced along the trailing edge.

DETAILED DESCRIPTION OF THE INVENTION

Figure 1:
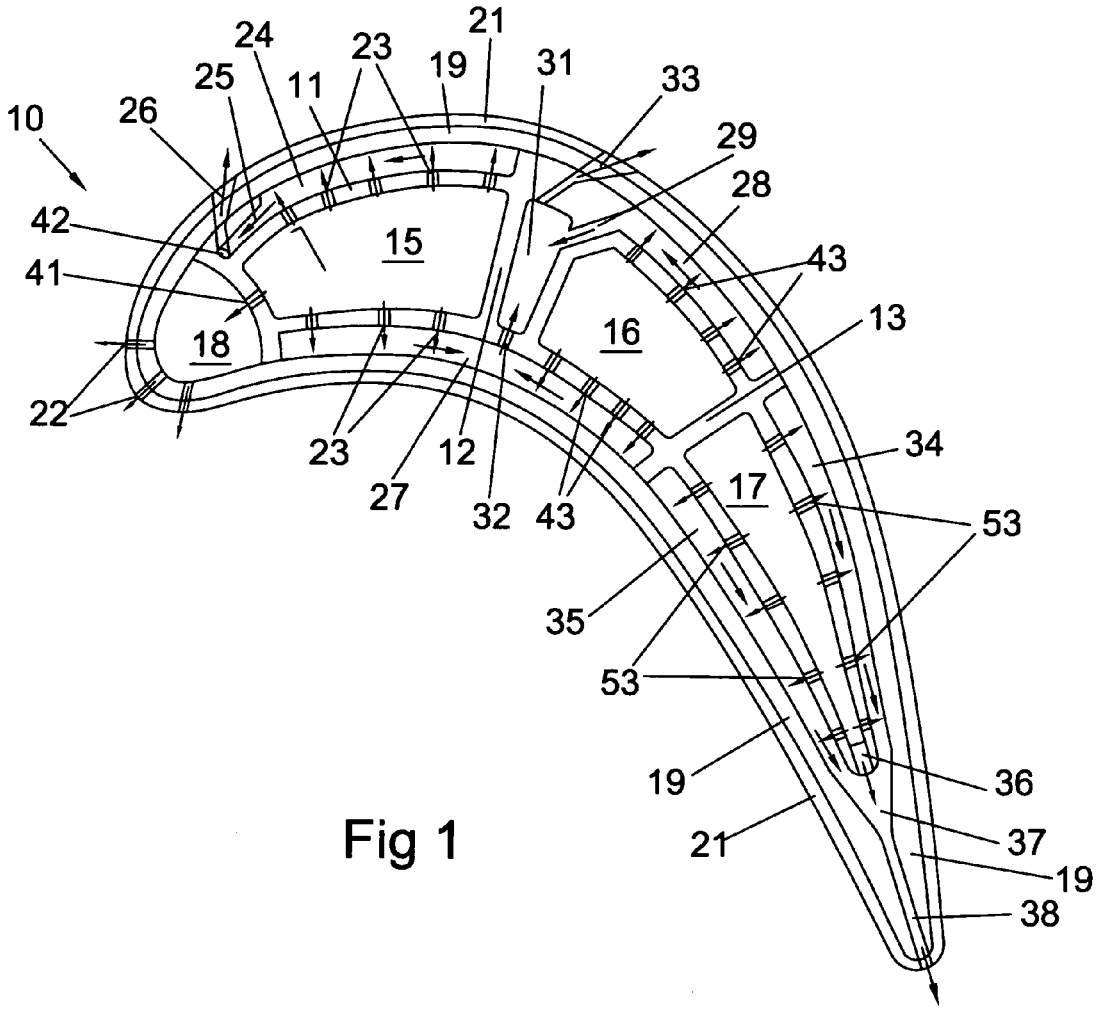
FIG. 1 shows a cross section view of the airfoil of the present invention.

The present invention is a turbine airfoil such as a rotor blade with a cooling circuit that provides convective cooling to the airfoil main body, and impingement cooling and film cooling to the outer wall of the airfoil in order to maximize the cooling while minimizing the amount of cooling air used. FIG. 1 shows the blade 10 of the present invention in a cross section view. The blade 10 includes a blade main body 11 having the general shape of the airfoil with a leading edge and a trailing edge, and a pressure side and a suction side. The blade main body includes walls of such thickness to provide sufficient structural strength to support the airfoil assembly 10. The blade main body 11 includes a rib 12 that separates a first or forward cooling air supply channel 15 from a spent air collector cavity 31. Another rib separates the spent air collector cavity 31 from a second or mid-chord cooling air supply channel 16. A third rib 13 separates the second or mid-chord channel 16 from a third or trailing edge cooling air supply channel 17. A leading edge cooling supply cavity 18 is connected to the forward supply channel 15 through metering and impingement holes 41. Film cooling holes 22 forming a well known showerhead arrangement provides film cooling for the leading edge of the blade.

Impingement channels are arranged along the blade main body on both sides of the blade to form impingement channels for near wall cooling of an outer wall 19 of the blade. A TBC or thermal barrier coating 21 is applied over the outer wall 19. a suction side impingement channel 24 is formed between the blade main body 11 and the outer wall 19 and includes a plurality of impingement holes 23 connecting the forward cooling supply channel 15 to the suction side impingement channel 24.

A pressure side impingement channel 27 is located on the pressure side of the blade main body 11 and is connected to the forward cooling supply channel 15 by a plurality of metering and impingement holes 23, the second or mid-chord cooling supply channel 16 is connected to a suction side impingement channel 28 on the suction side through metering and impingement holes 43, and is connected to the pressure side impingement channel 27 through metering and impingement holes 43, the pressure side impingement channel 27 is common to both the forward and mid-chord cooling supply channels 15 and 16 for the pressure side of the blade main body 11.

Impingement air flowing into the suction side impingement channel 28 adjacent to the mid-chord cooling air supply channel 16 is directed into the spent air collector cavity 31 through a metering hole 29. Impingement air flowing into the common pressure side impingement channel 27 common to the forward and mid-chord cooling air supply channels 15 and 16 is directed into the spent air collector cavity 31 through a metering hole 32. The cooling air from the spent air collector cavity 31 is discharged through film cooling holes 33 on the suction side of the blade just upstream from the gage point.

The cooling air supply channel 17 on the trailing edge region passes cooling air through metering and impingement holes 53 into a pressure side impingement channel 35 and a suction side impingement channel 34. The cooling air in the two impingement channels 34 and 35 then flows out a channel exit hole 36 and into a collector channel 37 and out through trailing edge exit holes 38 spaced along the trailing edge of the blade.

Figure 2:
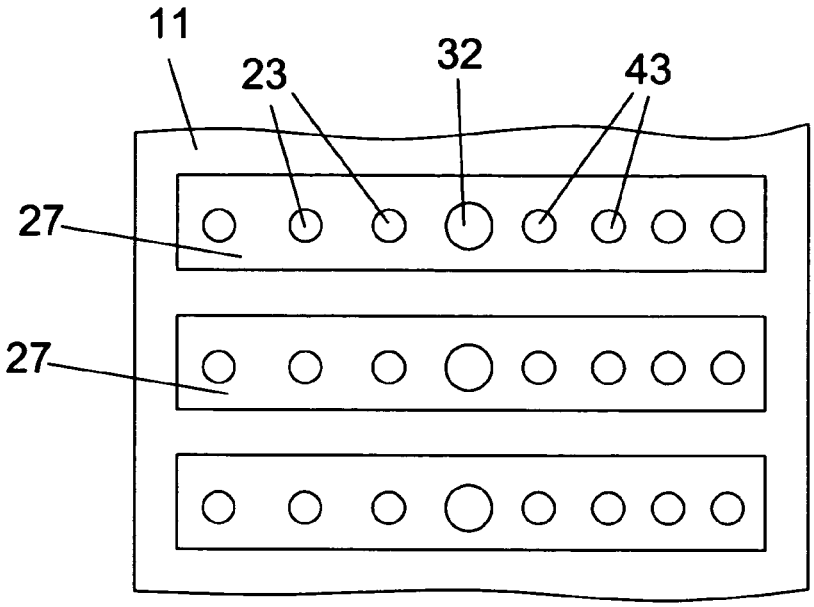
FIG. 2 shows a side view of a cross section of the pressure side impingement cavity of the airfoil in FIG. 1.

As seen in FIG. 2, the impingement channels spaced along the blade main body on both sides are segmented or compartments along the span-wise direction of the blade. FIG. 2 shows a front view of the pressure side impingement channel 27 common to both of the forward and mid-chord cooling air supply channels 15 and 16. The impingement channel 27 is shown with the three metering and impingement holes 23 connected to the forward supply channel 15, the metering hole 32 leading into the spent air collector cavity 31, and the four holes 43 connected to the second supply channel 16. Three compartments are shown in FIG. 2, each connected to the common cooling air supply channel through its own metering and impingement holes. Cooling air supplied through the trailing edge supply channel 17 is discharged out through the exit holes 38.

Figure 3:
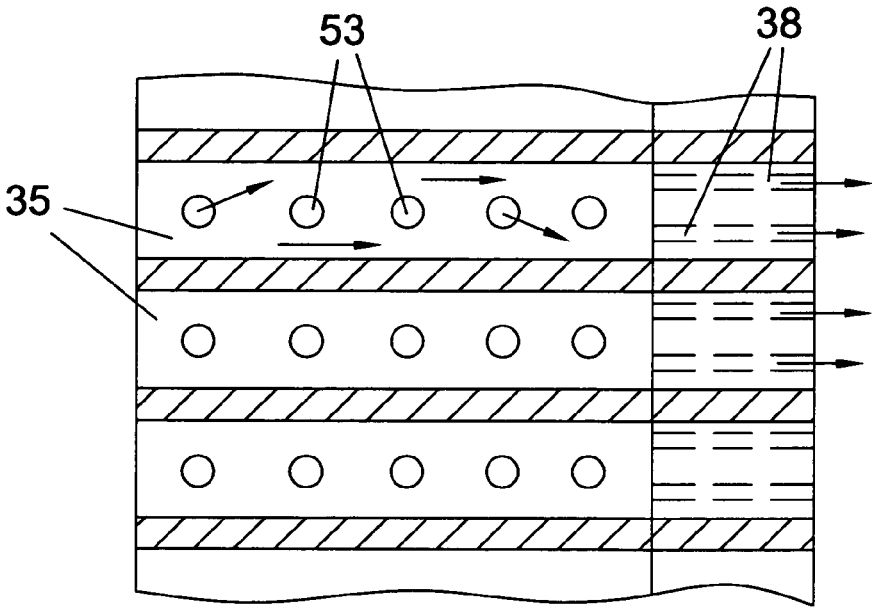
FIG. 3 shows a side view of a cross section of the trailing edge impingement cavity of the airfoil in FIG. 1.

FIG. 3 shows a front view of a cross section of the trailing edge region of the blade with the pressure side impingement channel 35 extending along the blade toward the exit holes 38. Horizontal ribs also separate the impingement channels 35 along the span-wise direction of the blade. Each separated impingement channel 35 is connected to the trailing edge supply channel 17 through metering and impingement holes 53. Each impingement channel 35 is connected to a plurality of the exit holes 38. Two are shown in FIG. 3, but three could also be used for each channel 35.

Operation of the cooling flow circuit of the blade 10 in the present invention will now be described with respect to FIG. 1. Cooling air, typically from the engine compressor, is supplied to the three separate cooling supply channels 15, 16, and 17 through passages formed in the blade root. Cooling air in the forward supply channel 15 flows through the pressure side holes 23 and into the pressure side impingement channel 27 to provide impingement cooling to the outer blade wall 19 on the pressure side. Cooling air also flows through the suction side holes 23 and into the suction side impingement channel 24 to provide impingement cooling to the suction side outer wall 19. The impingement cooling air collected in the suction side impingement channel 24 then flows out the film cooling holes 26 located at the upstream end of the channel 24 to provide film cooling to the outer surface of the outer wall 19 or the TBC 21 if applied. Cooling air from the forward supply channel 15 also flows through the metering holes 18 and into the leading edge supply cavity 18, and then through the showerhead film cooling holes 22 to provide film cooling for the blade leading edge.

The second or mid-chord cooling air supply channel 16 delivers cooling air to the suction side impingement channel 28 through the holes 42 for impingement cooling of the suction side outer wall 19 in this section of the blade. Impingement cooling air collected in the channel 28 is then directed through the metering hole 29 and into the spent air collector cavity 31. The mid-chord supply channel 16 also directs cooling air into the common pressure side impingement channel 27 spaced along the pressure side between the forward and mid-chord supply channels 15 and 16 through the holes 43. Cooling air collected in the common pressure side impingement channel 27 is collected and directed through the metering hole 32 into the spent air collector cavity 31. The cooling air collected in the collector cavity 31 is then discharged out through the film cooling hole 33 located on the suction side wall upstream of the gage point to provide film cooling for the suction side outer wall 19 or TBC 21 is applied.

The trailing edge cooling supply channel 17 passes cooling air through the holes 53 and into the suction side impingement channel 34 and the pressure side impingement channel 35 to provide impingement cooling to that section of the blade on the pressure side and suction side. The impingement cooling air is then collected in the trailing edge collector cavity 37 and discharged through the exit holes 38 spaced along the trailing edge to provide convection cooling in the trailing edge region.

The airfoil leading edge is cooled with a single row of backside span-wise impingement holes. The cooling air is supplied through the leading edge cooling supply cavity 15 and impinges onto the backside of the leading edge wall to provide backside impingement convective cooling prior to discharging through the leading edge showerheads 22 to provide film cooling for the blade leading edge region. In the forward section of the blade suction side surface, the multi-hole impingement cooling air is supplied through the airfoil leading edge supply cavity 15, impinges onto the backside of the airfoil forward surface, and the spent cooling air flows forward and is then discharged onto the airfoil suction side surface to provide film cooling. The mid-chord section of the suction side surface, downstream of the gage point, a counter flow similar to the forward section cooling is utilized. The spent cooling air is discharged into the mid-chord collecting cavity 31 prior to discharging onto the suction surface upstream of the gage point. For the pressure side cooling, a parallel flow is used for the forward section while a counter flow is used for the aft section. The spent air is discharged into the cooling air collector cavity 31 through a row of metering holes 32. The use of the cooling air collector cavity 31 also for the collection of the spent cooling air from the airfoil pressure surface and downstream of the airfoil suction surface and discharge the spent cooling air upstream of the airfoil gage point as well as transporting the pressure side spent cooling air to provide film cooling for the airfoil suction side surface. The airfoil trailing edge cooling, aft flowing multi-impingement is used for both of the pressure and suction sides. The spent cooling air discharges through a row of trailing edge exit slots 38 for the cooling of the trailing edge corner prior to exit from the airfoil.

From the use of the separate impingement compartments spaced along the span-wise direction of the blade, and with the separate metering and impingement holes and separate cooling air supply channels, the cooling flow amount and pressure can be individually controlled to provide the desired amount of impingement cooling and film cooling to the particular area of the blade. This allows for certain hot regions or areas of the blade to be properly cooled without sending too much cooling air to areas that do not need the cooling. Also, by providing for the film cooling holes 26 and 33 on the suction side of the blade in combination with the common impingement channel 27 on the pressure side of the blade, adequate film cooling is provided for on the suction side of the blade while enough cooling through impingement and convection is performed on the cooler pressure side. Maximum cooling of the blade main body and the outer blade wall is accomplished while using a minimal amount of cooling air. Therefore, turbine efficiency is increased.

An improvement over the Bather et al patent described above for the airfoil main body near wall cooling can be achieved by the cooling circuit of the present invention which includes the multiple near wall compartments in conjunction with multi-hole impingement cooling for the airfoil main body. The multi-hole impingement cooling design of the present invention is constructed at inline formation within each chord-wise compartment. Individual compartments are designed based on the airfoil gas side pressure distribution in both the chord-wise and span-wise directions. In addition, each individual compartment can be designed based on the airfoil local external heat load to achieve a desired local metal temperature. These individual chord-wise compartments are constructed in an inline array along the airfoil main body wall. With this unique cooling construction approach, the maximum usage of cooling air for a given airfoil inlet gas temperature and pressure profile is achieved. In addition, the entire airfoil utilizes the multi-hole impingement cooling technique for the backside convective cooling as well as flow metering purpose and the spent cooling air is discharged onto the airfoil surface at the high heat load region where film cooling is most desired. The combination effects of multi-hole impingement cooling plus film cooling yields a very high cooling effectiveness and uniform wall temperature for the airfoil main body wall.

I claim the following:

1. A turbine airfoil used in a gas turbine engine, the airfoil comprising:

an airfoil main body having a shape of an airfoil with a pressure side and a suction side, and a leading edge and a trailing edge;

a forward cooling air supply channel formed within the airfoil main body;

a mid-chord cooling supply channel formed within the airfoil main body;

a spent air collector cavity formed within the airfoil main body and positioned between the forward and mid-chord cooling supply channels;

a first pressure side impingement channel in fluid communication with at least the forward cooling air supply channel and the spent air collector channel;

a first suction side impingement channel in fluid communication with the mid-chord cooling air supply channel and the spent air collector channel; and, a first suction side film cooling hole in fluid communication with the spent air collector channel.

2. The turbine airfoil of claim 1, and further comprising:

the fluid communication between the supply channels and the impingement channels are metering and impingement holes.

3. The turbine airfoil of claim 1, and further comprising:

the first pressure side impingement channel is also in fluid communication with the mid-chord cooling air supply channel.

4. The turbine airfoil of claim 1, and further comprising:

a second suction side impingement channel in fluid communication with the forward cooling air supply channel; and, a second suction side film cooling hole in fluid communication with the second suction side impingement channel.

5. The turbine airfoil of claim 1, and further comprising:

the first suction side film cooling hole opens onto the suction side airfoil wall at a location upstream of the airfoil gage point.

6. The turbine airfoil of claim 4, and further comprising:

the second suction side film cooling hole opens onto the suction side airfoil wall at a location just downstream from the airfoil leading edge region.

7. The turbine airfoil of claim 1, and further comprising:

a trailing edge cooling air supply channel formed in the airfoil main body;

a pressure side impingement channel and a suction side impingement channel, both channels being in fluid communication with the trailing edge supply channel; and, a trailing edge exit cooling hole in fluid communication with both the pressure side and suction side impingement channels.

8. The turbine airfoil of claim 7, and further comprising:

the trailing edge cooling air supply channel being fluidly separated from the mid-chord cooling air supply channel such that cooling air from the mid-chord supply channel does not mix with the cooling air supplied from the trailing edge cooling supply channel.

9. The turbine airfoil of claim 7, and further comprising:

the fluid communication between the trailing edge cooling supply channel and the pressure side and the suction side impingement channels is a plurality of metering and impingement holes.

10. The turbine airfoil of claim 1, and further comprising:

the impingement channels are separate compartments spaced along the airfoil span-wise direction.

11. The turbine airfoil of claim 1, and further comprising:

a leading edge cooling air supply cavity in fluid communication with the forward cooling air supply channel through at least one metering and impingement hole; and, a showerhead arrangement of film cooling holes in fluid communication with the leading edge cooling supply cavity.

12. A turbine airfoil used in a gas turbine engine, the airfoil comprising:

an airfoil main body having a shape of an airfoil with a pressure side and a suction side, and a leading edge and a trailing edge;

a forward cooling air supply channel formed within the airfoil main body;

a first pressure side impingement channel in fluid communication with the forward cooling air supply channel;

a first suction side impingement channel in fluid communication with the forward cooling air supply channel;

a first suction side film cooling hole in fluid communication with the first pressure side impingement channel;

a second suction side film cooling hole in fluid communication with the first suction side impingement channel, the second suction side film cooling hole being located upstream from the first suction side film cooling hole;

a leading edge cooling supply cavity in fluid communication with the forward cooling air supply channel; and, a showerhead arrangement in fluid communication with the leading edge cooling air supply channel.

13. The turbine airfoil of claim 12, and further comprising:

the fluid communication between the forward cooling supply channel and the pressure side and suction side impingement channels is a plurality of metering and impingement holes.

14. The turbine airfoil of claim 12, and further comprising:

the impingement channels are a plurality of separate compartments spaced along the airfoil span-wise direction.

15. The turbine airfoil of claim 12, and further comprising:

a spent air collector cavity located adjacent to and downstream from the forward cooling air supply channel; and, the fluid communication between the pressure side impingement channel and the first suction side film cooling hole including the spent air collector cavity.

16. The turbine airfoil of claim 15, and further comprising:

a mid-chord cooling air supply channel located adjacent to the spent air collector cavity;

a second suction side impingement channel in fluid communication with the mid-chord cooling air supply channel and the spent air collector cavity; and, the first pressure side impingement channel is also in fluid communication with the mid-chord cooling air supply channel.

17. The turbine airfoil of claim 12, and further comprising:

a trailing edge cooling air supply channel formed in the airfoil main body;

a pressure side impingement channel and a suction side impingement channel, both channels being in fluid communication with the trailing edge supply channel; and, a trailing edge exit cooling hole in fluid communication with both the pressure side and suction side impingement channels.

18. The turbine airfoil of claim 16, and further comprising:

a trailing edge cooling air supply channel formed in the airfoil main body;

a pressure side impingement channel and a suction side impingement channel, both channels being in fluid communication with the trailing edge supply channel; and, a trailing edge exit cooling hole in fluid communication with both the pressure side and suction side impingement channels.

* * * * *